US006429604B2

(12) United States Patent
Chang

(10) Patent No.: US 6,429,604 B2
(45) **Date of Patent: *Aug. 6, 2002**

(54) POWER FEEDBACK POWER FACTOR CORRECTION SCHEME FOR MULTIPLE LAMP OPERATION

(75) Inventor: Chin Chang, Yorktown Heights, NY (US)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/489,753

(22) Filed: Jan. 21, 2000

(51) Int. Cl.[7] ..... H05B 37/00

(52) U.S. Cl. ..... 315/244; 315/224; 315/247; 315/209 R; 315/DIG. 7

(58) Field of Search ..... 315/247, 224, 315/244, 209 R, 219, 291, 307, DIG. 7; 363/37

(56) References Cited

U.S. PATENT DOCUMENTS

| | | | | |
|---|---|---|---|---|
| 4,207,498 A | * | 6/1980 | Spira et al. | 315/97 |
| 4,511,823 A | | 4/1985 | Eaton et al. | 315/241 |
| 5,404,082 A | | 4/1995 | Hernandez et al. | 315/219 |
| 5,410,221 A | | 4/1995 | Mattas | 315/307 |
| 5,519,289 A | | 5/1996 | Katyl et al. | 315/224 |
| 5,764,496 A | | 6/1998 | Sato et al. | 363/37 |
| 5,874,809 A | * | 2/1999 | Hagen | 315/224 |
| 5,877,592 A | * | 3/1999 | Hesterman et al. | 315/106 |
| 5,907,223 A | * | 5/1999 | Gu et al. | 315/247 |
| 5,949,199 A | * | 9/1999 | Qian et al. | 315/307 |
| 6,016,257 A | * | 1/2000 | Chang et al. | 363/17 |
| 6,023,132 A | * | 2/2000 | Crouse et al. | 315/307 |
| 6,046,914 A | * | 4/2000 | Lauter | 363/37 |
| 6,137,234 A | * | 10/2000 | Willaert et al. | 315/209 R |

FOREIGN PATENT DOCUMENTS

| | | |
|---|---|---|
| WO | WO9908373 | 2/1999 |
| WO | WO0038483 | 6/2000 |

OTHER PUBLICATIONS

"An Improved Electronic Ballast for the Fluorescent Lamp", by Wei Chen, Virginia Polytechnic Institute and State University, Virginia Power Electronics Center, Aug. 1995.

* cited by examiner

*Primary Examiner*—Haissa Philogene

(57) ABSTRACT

A ballast circuit for a single or multiple lamp parallel operation where at each lamp a condition may be controlled such that the amplitude of a resonant inductor current and an output voltage are almost constant in the steady state. The circuit consists of a half-bridge of a DC storage capacitor, a DC blocking capacitor, power transistors which alternately switch on and off and have a 50% duty ratio, and an LLC resonant converter having a resonant inductor and one or more resonant capacitors. The circuit also includes an output transformer providing galvanic isolation for a double path type power feedback scheme. The output transformer produces magnetizing inductance utilized for power feedback circuit optimization and is connected right after the resonant inductor of the half-bridge circuit.

25 Claims, 19 Drawing Sheets

POWER FEEDBACK POWER FACTOR CORRECTION SCHEME FOR MULTIPLE LAMP OPERATION

BACKGROUND OF THE INVENTION

1. Field of the Invention

This invention relates to power feedback circuits. More particularly, the invention relates to a double path type power feedback circuit for multiple lamp parallel operation.

2. Description of the Background of the Invention

The low power factor (PF) of conventional electromagnetic compact fluorescent lamps (CFLS) is due to the fact that their voltage and current are not in phase and/or to the higher harmonic content in the current waveform. Electronics in the electronic CFLs, as well as in all other electronic equipment, generate harmonic currents. Harmonic currents are closely related to a reduced PF and can disturb other equipment. Furthermore, a very high harmonic distortion on a utility network may reduce the performance of the transformers and could ultimately damage them.

An electronic CFL has a typical power factor of between 0.5 and 0.6, but the current cannot be simply compensated for with a capacitor. Instead, a filter has to be introduced, either in the ballast of the lamp itself or somewhere in the electricity network. In countries where the International Electroctechnical Commission (IEC) standards are adopted, the lighting equipment must have a power factor better than 0.96 and a Total Harmonic Distortion (THD) below 33%. However an exception is made in the IEC lighting standards for equipment with a rated power of less than 25W.

The single stage electronic ballast based on the power feedback principles has been disclosed and described in numerous patents, including U.S. Pat. No. 5,404,082 in the names of A. F. Hernandez and G. W. Bruning, and entitled "High Frequency Inverter with Power-line-controlled Frequency Modulation," and U.S. Pat. No. 5,410,221 in the names of C. B. Mattas and J. R Bergervoet, and entitled "Lamp Ballast with Frequency Modulated Lamp Frequency". The type of ballast described in these patents has a lower parts count due to a modulation scheme imbedded in a power conversion process. These patents describe the conversion of a low frequency alternating current (AC) voltage source to a high frequency AC voltage source via a properly designed power feedback scheme. These patents further describe how the harmonic content of an input current can be limited within the International Electrotechnical Commission (IEC) specification while the output current crest factor remains acceptable. Topologically, the single stage power factor correction is achieved based on the power feedback to the node between the full-bridge rectifier output and the DC electrolytic capacitor.

To date, all of the power feedback schemes are used for a single lamp and a two lamp series configuration, with and without dimming. It is important to point out that in such a class of applications the value of the resonant converter parameters L and C are fixed, even though the load current can be changed during the dimming process. Technically, this implies that the circuit resonant frequency is fixed while the quality factor (Q) is changed with the load. The quality factor Q may be described as the ratio of the resonant frequency to bandwidth.

In the multiple lamp operation circuit 10, shown in FIG. 1, lamps $R_{lp}$ are connected in parallel, via ballast capacitors $C_{1p}$, respectively, due to the. independent lamp operation (ILO) requirements. Lamps $R_{lp}$ and ballast capacitors $C_{lp}$ are then connected in parallel to a transformer $T_1$, which in turn is connected in parallel to a capacitor $C_3$. Capacitor $C_3$ is connected to diodes $D_3$, $D_4$ of the full-bridge rectifier represented by diodes $D_1$–$D_4$, and diodes $D_1$, $D_2$ are connected to a resonant inductor $L_1$, which in turn is connected to a diode $D_5$. Diode $D_5$ is further connected to a drain terminal of a positive-negative-positive (PNP) transistor $Q_2$, and the source terminal of transistor $Q_2$ is connected to a drain of a PNP transistor $Q_3$. Gates of both transistors $Q_1$ and $Q_{2g}$ are connected to a high voltage control integrated circuit 12.

A first terminal of a resistor R, is connected to the source terminal of the transistor $Q_3$ and a second terminal of this resistor is connected to a first terminal of the capacitor $C_3$, a resistor $R_2$ and diodes $D_3$ and $D_4$. The high voltage control integrated circuit 12 further connects to the connection of the source terminal of the transistor $Q_3$ and a first terminal of the resistor $R_l$, individually to a capacitor $C_2$, and to the interconnection of the inductor $L_2$ and capacitor $C_3$. The capacitor $C_2$ and the inductor $L_2$ are serially interconnected. The inductor $L_2$ is further connected to the capacitor $C_3$.

A capacitor $C_1$ is on a first side connected between a diode $D_5$ and the drain terminal of transistor $Q_2$, and on the second side between diodes $D_3$, $D_4$ and the resistor $R_1$. A drain terminal of the PNP transistor $Q_1$ is connected to the junction of the inductor $L_1$ and the diode $D_5$ and the source terminal of the transistor $Q_1$ is connected to a resistor $R_2$, which is also connected diodes $D_3$ and $D_4$, and the capacitor $C_1$. A power factor controller unit 14 is connected to the inductor $L_1$, the gate of the transistor $Q_1$, to the connection of the source terminal of transistor $Q_1$ and resistor $R_2$, and to the connection of diode $D_5$ and capacitor $C_1$.

In this configuration the resonant capacitance is strongly load dependent. This dependence with respect to 0 to 4 lamp combinations is shown in FIG. 2*a*, where five distinct resonant frequency curves are charted on a voltage/frequency chart. Here, the zero lamp curve 20 represents a scenario in which no lamps are connected, the one lamp curve 22 represents a scenario in which one lamp is connected, the two lamp curve 24 represents a scenario in which two lamps are connected, the three lamp curve 26 represents a scenario in which three lamps are connected, and finally the four lamp curve 28 represents a scenario in which four lamps are connected. The respective frequency peaks of the curves 22, 24, 26 and 28 are $9.554215\times10^4$, $7.52929\times10^4$, $6.503028\times10^4$, and $5.843909\times10^4$.

FIG. 2*b* shows the same five distinct resonant frequency curves, charted on a primary side resonant tank input phase/frequency chart. In this graph, the zero lamp curve 30 reaches a low phase point of −90, the one lamp curve 32 reaches a low phase point of −23.360583, the two lamp curve 34 reaches a low phase point of −14.71952, and the three lamp curve 36 reaches a low phase point of −5.566823.

Traditionally, the power feedback power factor correction circuits are limited to a fixed load operation. When the load changes, the input line power factor and current THD performance drop. Even more severe situation is that the DC bus voltage increases dramatically as the load decreases. Such DC bus as voltage over boost usually leads to the damage of power switches if they are not substantially over designed. This problem is encountered during the development of a power feedback circuit for four lamp ballast circuits.

In view of those variables and the sinusoidal input voltage, it would be advantageous to have a simple single stage electronic ballast circuit based on the power feedback scheme for multiple lamp operation.

SUMMARY OF THE INVENTION

The ballast circuit of the invention is designed for a single or multiple lamp parallel operation, where at each lamp a condition may be controlled such that the amplitude (e.g. the switching frequency of the power transistors) output voltage is almost constant in the steady state. The present invention uses fewer high ripple current rated capacitors than the prior art while providing galvanic isolation. Furthermore, in addition to using smaller input filter sizes, the inventive circuit uses fewer fast reverse recovery diodes necessary for the prior art circuit schemes.

In order for the inventive power feedback circuit to work with multiple lamp combinations under variable load conditions and without severe DC bus voltage over boost, the resonant tank is designed with an LLC type resonant circuit instead of the previously used LC type. Accordingly, the circuit switching frequency is changed for each lamp number condition. When a lamp number condition is settled, the circuit operates at a selected frequency without line frequency modulation content.

The circuit of the invention comprises a DC storage capacitor, a DC blocking capacitor, a half-bridge of power transistors which alternately switch on and off and have a 50% duty ratio, and an LLC resonant converter having a resonant inductor, a output transformer, and one or more effective resonant capacitors. The circuit comprises an output transformer, which provides galvanic isolation for a double path type power feedback scheme. The output transformer produces magnetizing inductance utilized for power feedback circuit optimization and is inserted right after the resonant inductor of the half-bridge circuit.

Furthermore, the circuit of the invention comprises an input line filter having an inductor and a capacitor for bringing an input current close to a sinusoidal waveform with low THD, a current rectifier comprising a plurality of diodes, a plurality of fast reverse recovery diodes, and a plurality of ballasting capacitors that contribute to a resonant capacitance and allows the use of fewer capacitors in the half-bridge circuit.

BRIEF DESCRIPTION OF DRAWINGS

The foregoing objects and advantages of the present invention may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE INVENTION

Figure 1:
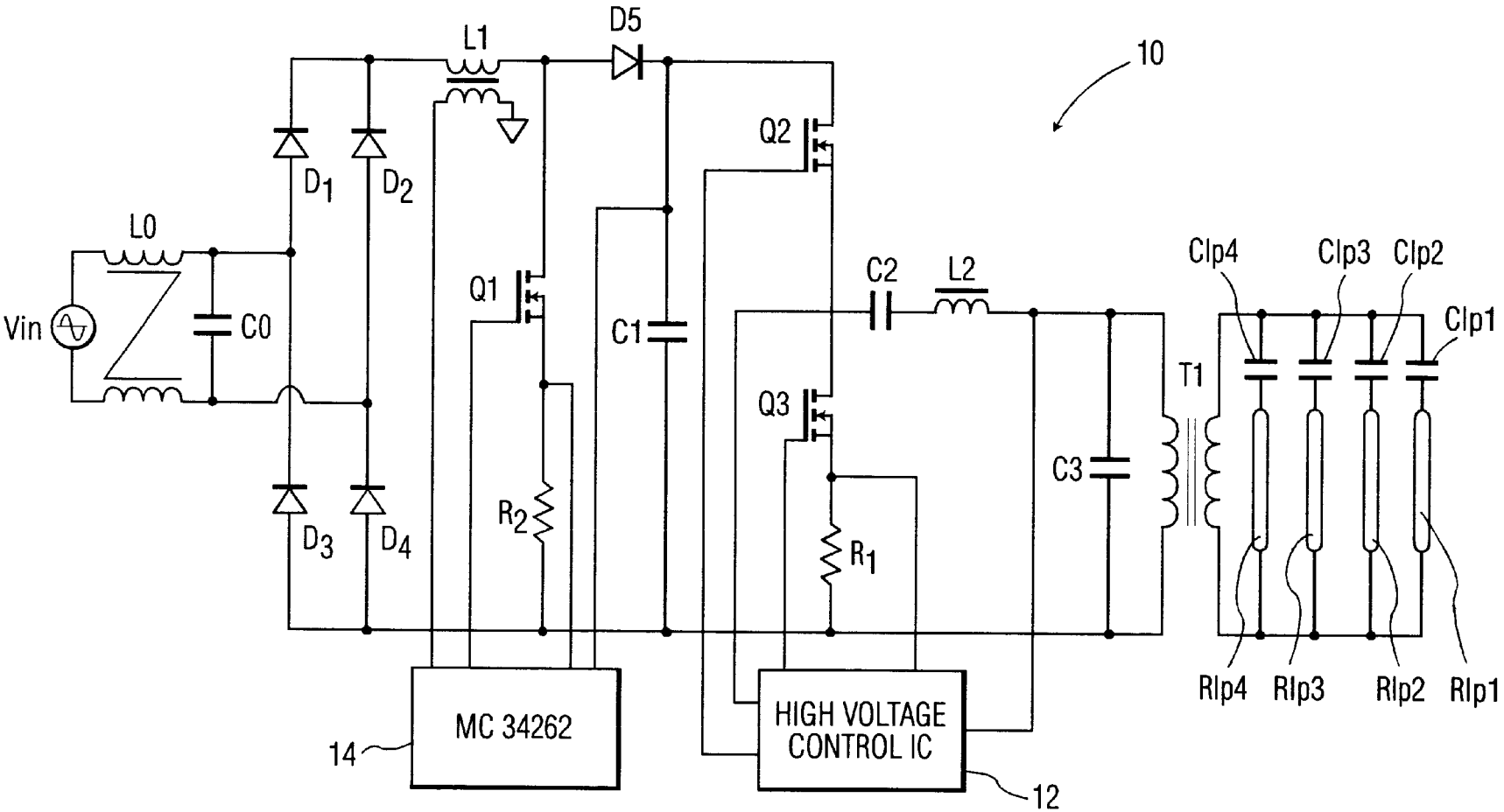
FIG. 1 PRIOR ART
FIG. 1 is a schematic representation of parallel connection of multiple lamps via ballasting capacitors of the prior art, where resonant capacitance is strongly load dependent.
Figure 2A:
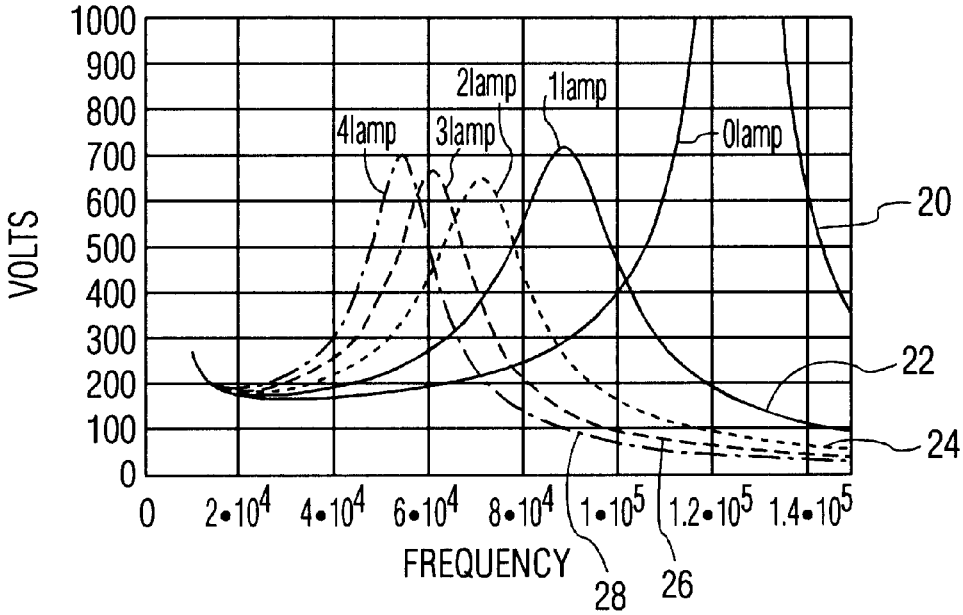
FIG. 2a PRIOR ART
FIG. 2*a* is a chart showing voltage/frequency dependence for each of zero to four lamp combinations.
Figure 2B:
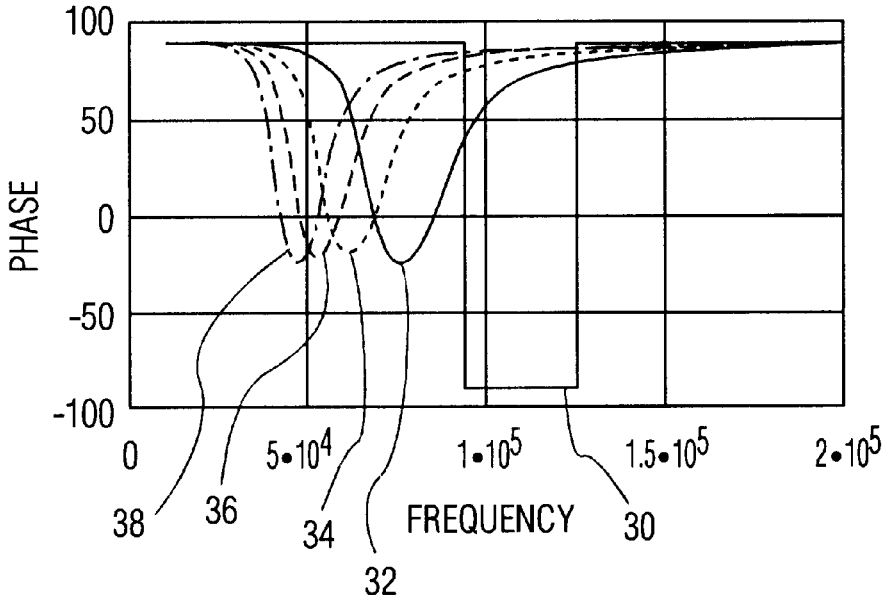
FIG. 2b PRIOR ART
FIG. 2*b* is a primary side resonant tank input phase/frequency chart showing the dependence with respect to zero to four lamp combinations.
Figure 3:
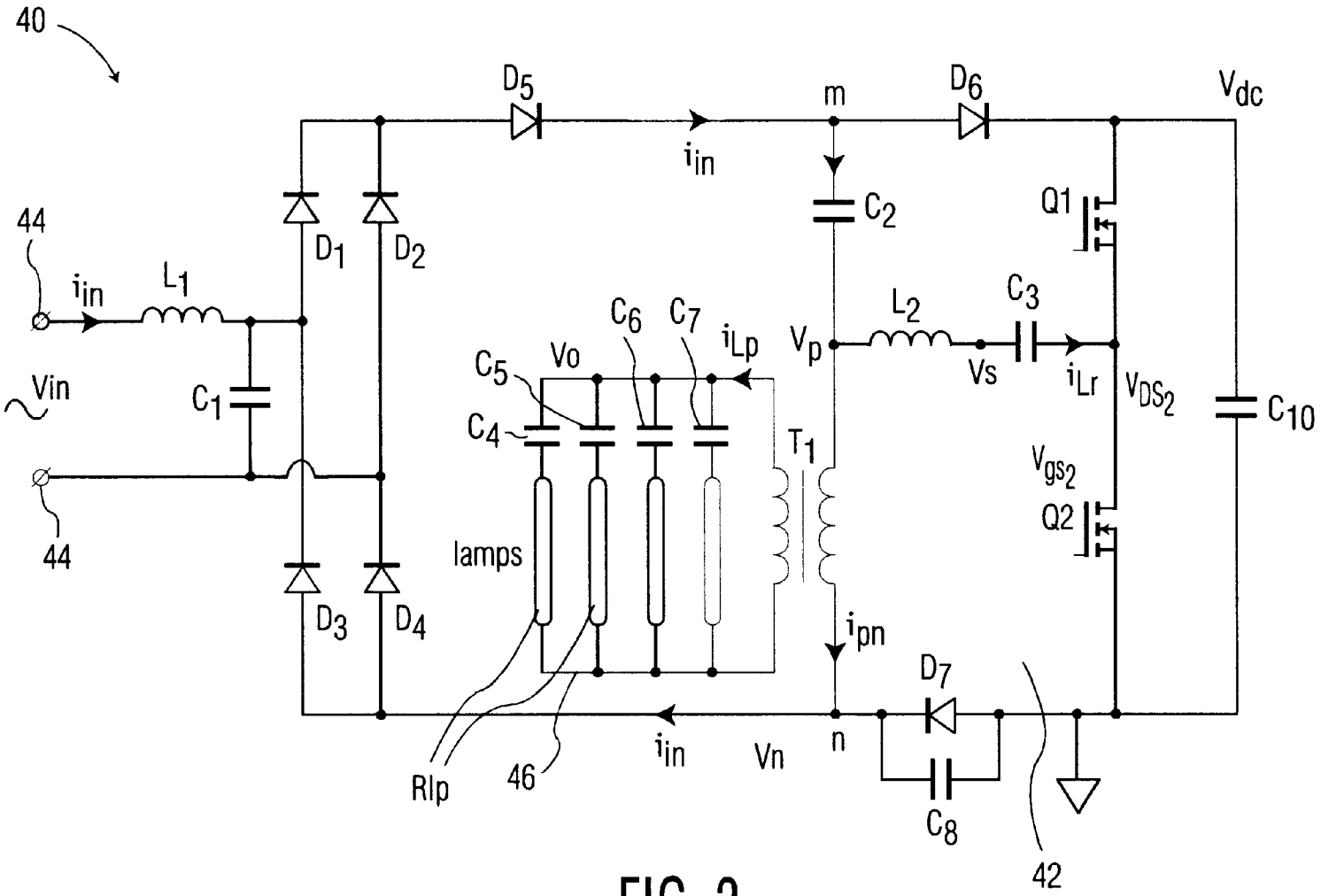
FIG. 3 is a schematic representation of the inventive ballast circuit.

FIG. 3 shows the ballast circuit 40 of the present invention. The input terminal 44 of the circuit 40 is connected to a resonant inductor $L_1$, which is connected between diodes $D_3$ and $D_1$ of the full-bridge rectifier, represented by diodes $D_1$–$D_4$. A capacitor $C_1$ is connected between the resonant inductor $L_1$ and that inductor's connection to diodes $D_3$ and $D_1$, and to the input terminal 44. The input terminal 44 further connects between diodes $D_4$ and $D_2$. Diodes $D_1$, $D_2$ are connected to a diode $D_5$, which is connected to a diode $D_6$. The diode $D_6$ is in turn connected to a capacitor $C_{10}$ that is connected to a resonant sink circuit 42.

The resonant sink circuit 42 comprises the transformer $T_1$ connected on one side to inductor $L_2$, which in turn is connected to a capacitor $C_3$, which is connected to the transistor $Q_2$. The transistor $Q_2$ connects to the diode $D_7$, which connects to the second terminal of the transformer $T_1$. A capacitor $C_2$ is connected between diodes $D_5$ and $D_6$ on one side and between the transformer $T_1$ and the inductor $L_2$ on the other side. A transistor $Q_1$ is connected to the diode $D_6$ and the capacitor $C_{10}$ on one side and to the capacitor $C_3$ and the transistor $Q_2$ on the other side. A capacitor $C_8$ is connected to each terminal of the diode $D_7$. Each lamp $R_{lp}$ of the multi lamp unit 46 is connected in series to a respective one of the capacitors $C_4$–$C_7$, and the lamp unit is then connected to the transformer $T_1$. Finally, the terminal of the transformer $T_1$ that is connected to the diode $D_7$ is also connected to diodes $D_{31}$, $D_4$.

Figure 4:
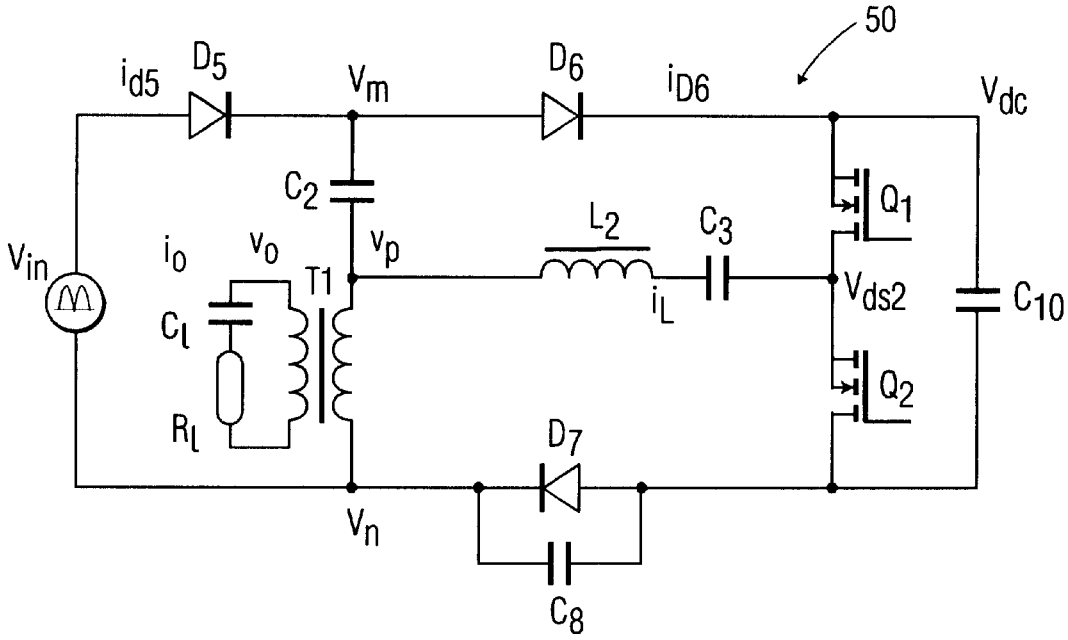
FIG. 4 is a schematic representation of a simplified version of the inventive ballast circuit adapted for equivalent circuit load.
Figure 5:
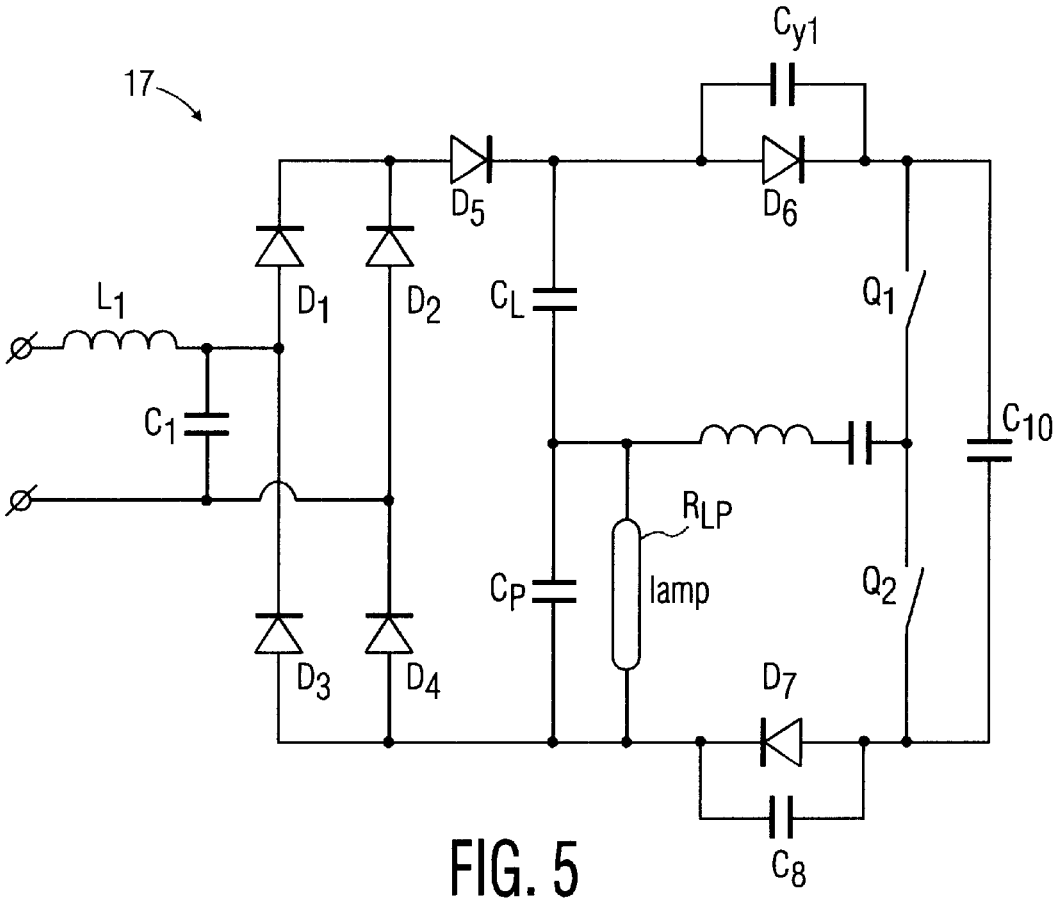
FIG. 5 PRIOR ART
FIG. 5 is a schematic representation of a prior art circuit adapted for a single lamp application.
Figure 6:
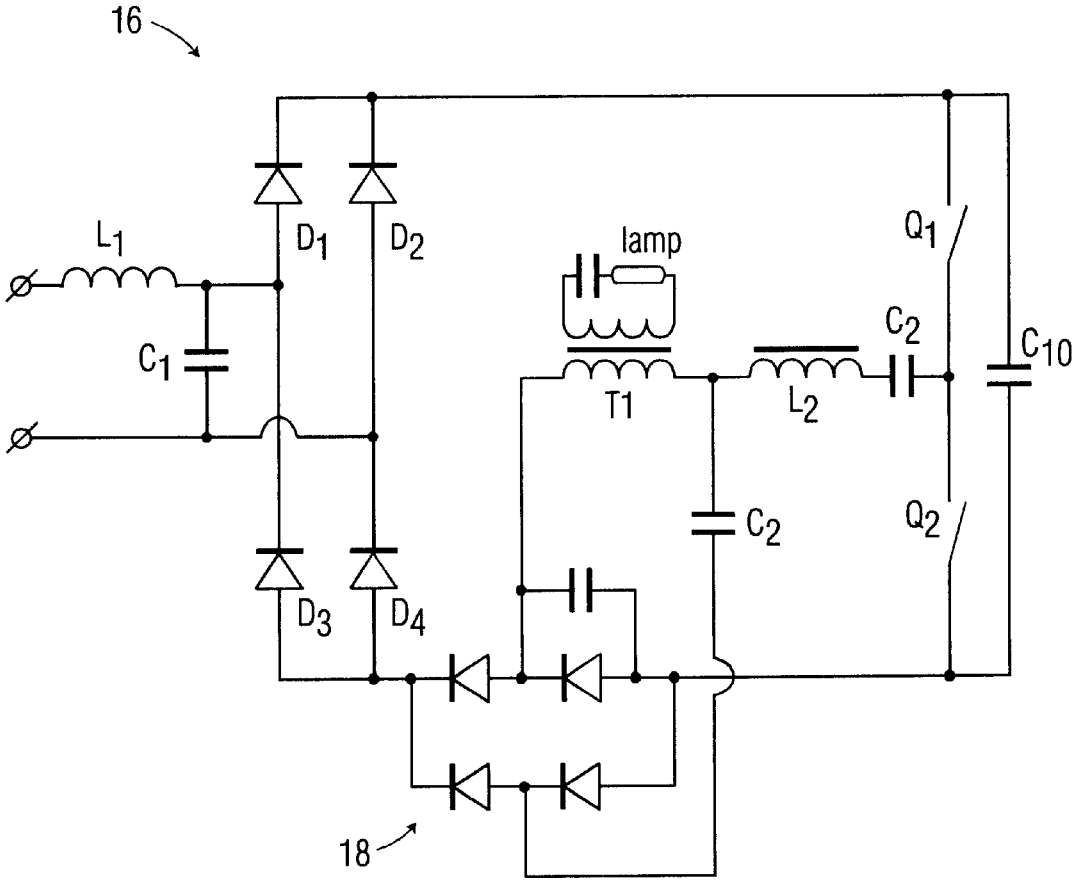
FIG. 6 PRIOR ART
FIG. 6 is a schematic representation of another prior art circuit adapted for a single lamp application.

The simplified version of the circuit 40 adapted for the single lamp application is shown in FIG. 4 and will be described below. The circuit 40 of the present invention uses fewer high ripple current rated capacitors than the prior art circuits shown in FIGS. 5 and 6, while providing galvanic isolation. One resonant inductor is contributed by the magnetizing inductance of the output transformer. By doing so, there is no need for an additional resonant inductor other than $L_2$ (FIG. 3). With a properly designed LLC type resonant tank, the lamp current crest factor is improved without using the capacitor $C_{yl}$ (FIG. 5) which must be used in the prior art circuit 17 (FIG. 5). Because the lamp ballasting capacitor $C_l$ may also act as a part of resonant capacitor, capacitor $C_p$ (FIG. 5) can also be removed. Furthermore, in addition to using smaller input filter sizes, the inventive circuit uses fewer fast reverse recovery diodes 18 (FIG. 6) necessary for the prior art circuit schemes, e.g., circuit 16 (FIG. 6). More importantly, the inventive circuit may be used for 4-lamp operation.

With reference to FIG. 3, to achieve the above benefits the inverter circuit 40 includes a half-bridge with a LLC resonant converter. The half-bridge includes two power Metal-Oxide-Silicon Field-Effect Transistors (MOSFETS) $Q_1$ and $Q_2$, the DC storage capacitor $C_{10}$ and the DC blocking capacitor $C_3$. One resonant inductor is $L_2$. The resonant capacitors include capacitors $C_2$, $C_8$, and the equivalent reffected capacitance of the load capacitors $C_4$–$C_7$. The galvanic isolation transformer $T_1$ is disposed between the resonant inductor $L_2$ and the diode $D_7$ to create a proper load matching.

Additionally, the magnetizing inductance of the isolation transformer contributes additional inductance to the resonant tank. The difference between a single path type power feedback scheme and a double path type power feedback scheme is that in each high frequency switching cycle the full-bridge rectifier, represented by diodes $D_1$–$D_4$, conducts once for the single path type and twice for the double path type power feedback scheme. For the same power delivery capability, the double path type power feedback scheme has fewer current stresses in the resonant tank circuit 42.

The resonant components are designed to set the resonant frequencies under certain operation conditions for each of the load cases. In order to achieve ILO, the voltage gain curves should reach and exceed certain required voltage levels, which are preferred to be kept almost constant at the output terminal 46 via proper control. The invention further employs fast reverse recovery diodes $D_5$–$D_7$.

Figure 8A:
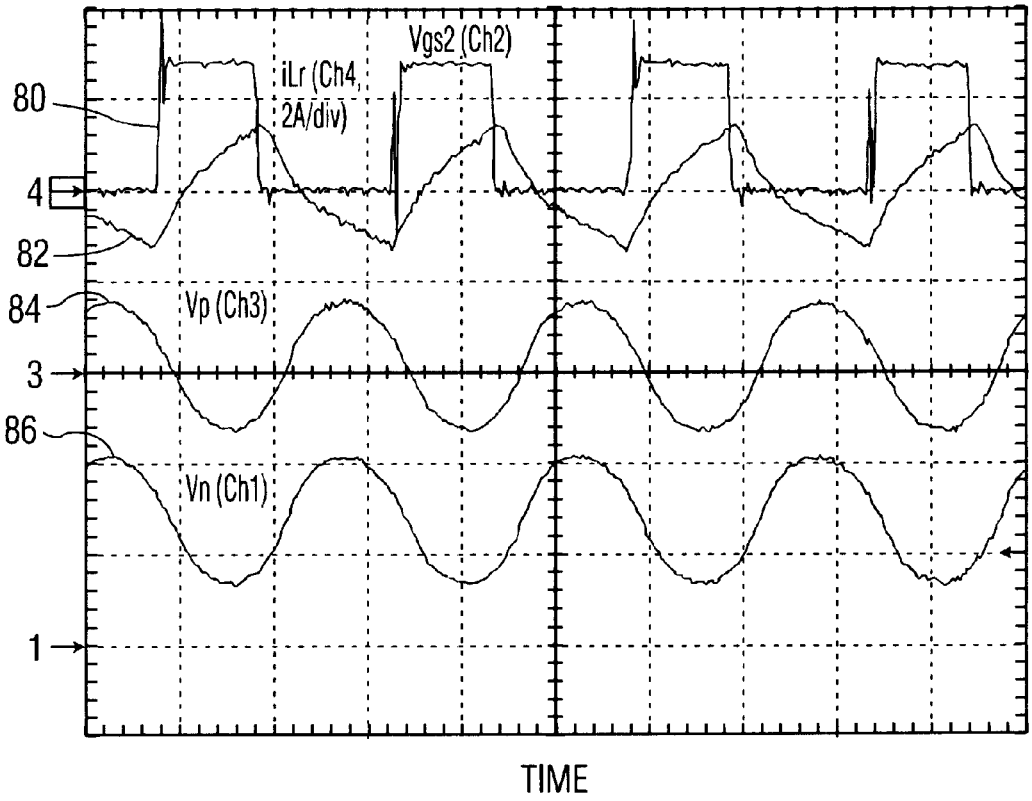
FIGS. 8(*a, b*), 9(*a, b*), 10(*a, b*) and 11(*a, b*) are input and output voltage/frequency oscilloscope waveform charts for a typical inventive circuit, showing the dependence with respect to one, two, three and four lamps.

FIG. 8*a* shows a square waveform curve 80 of voltage $V_{gs}$ (FIG. 3) used to drive the lower power switch $Q_2$ (FIG. 3). By alternatively switching power switches $Q_1$ (FIG. 3) and $Q_2$ (FIG. 3) on and off with a 50% duty ratio, the voltage $V_s$ (FIG. 3) has a peak-to-peak amplitude $V_{dc}$ (FIG. 3). Such voltage excites the resonant tank circuit 42 (FIG. 3) and results in the input current $i_{Lr}(t)$ 15 (FIG. 3) represented by the $i_{Lr}$ curve 82. Due to the resonant tank circuit 42 (FIG. 3), the $V_p$ curve 84 of voltage $V_p$ (FIG. 3) at point p (FIG. 3) and the $V_n$ curve 86 of voltage $V_n$ (FIG. 3) at point n (FIG. 3) are close to the sinusoidal waveform. Furthermore at each of the plurality of lamps, e.g., 1, 2, 3 and 4, a condition, e.g. the circuit operating frequency may be controlled such that the amplitude of the resonant inductor current $i_{Lr}(t)$ and the output voltage $V_o(t)$ (FIG. 3) are almost constant in the steady state.

Figure 7A:
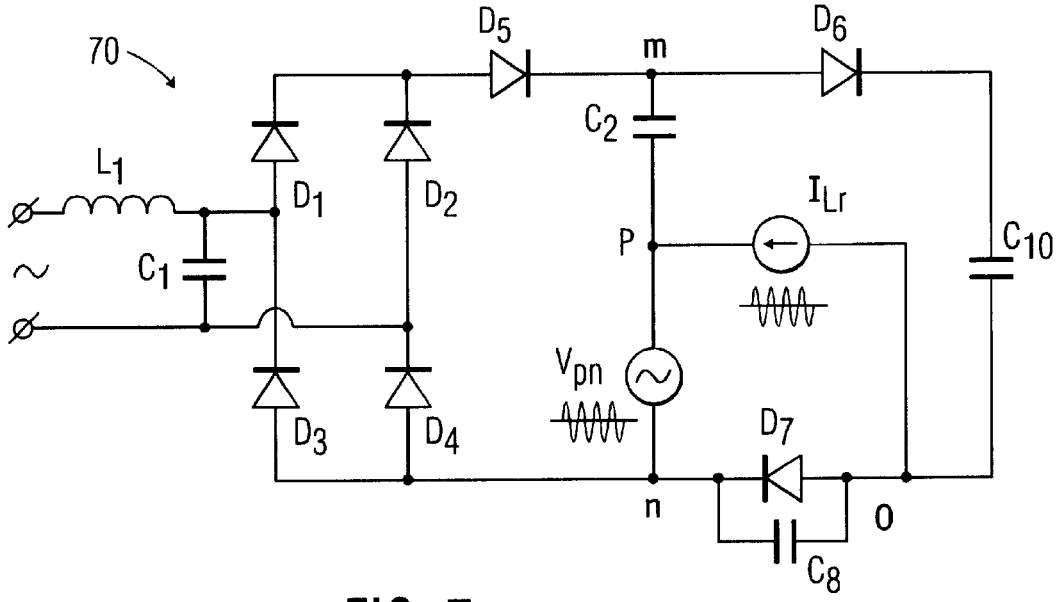
FIGS. 7*a, b* and *c* are each a schematic representation of an equivalent inventive circuit where the amplitude of the resonant inductor current and the output voltage are almost constant in the steady state.
Figure 7B:
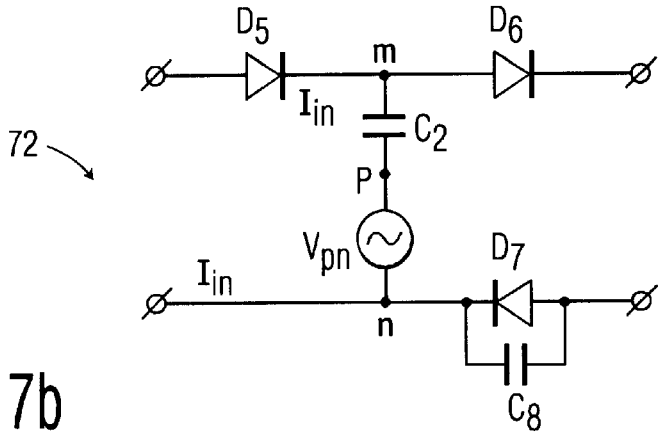
Figure 7C:
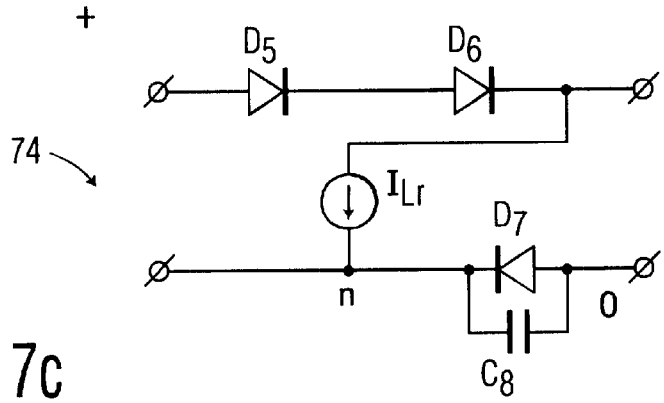
Figure 8B:
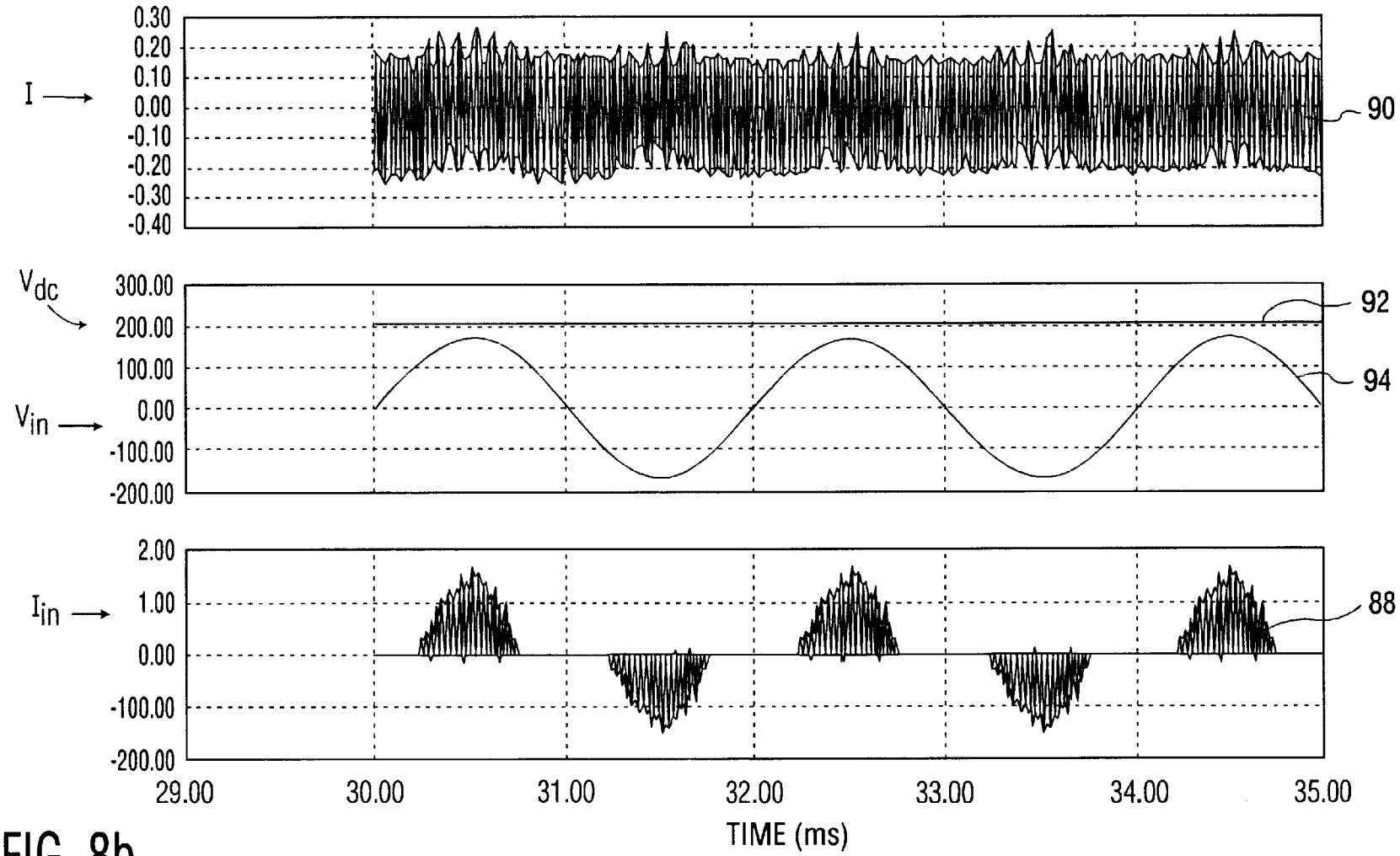
Figure 9A:
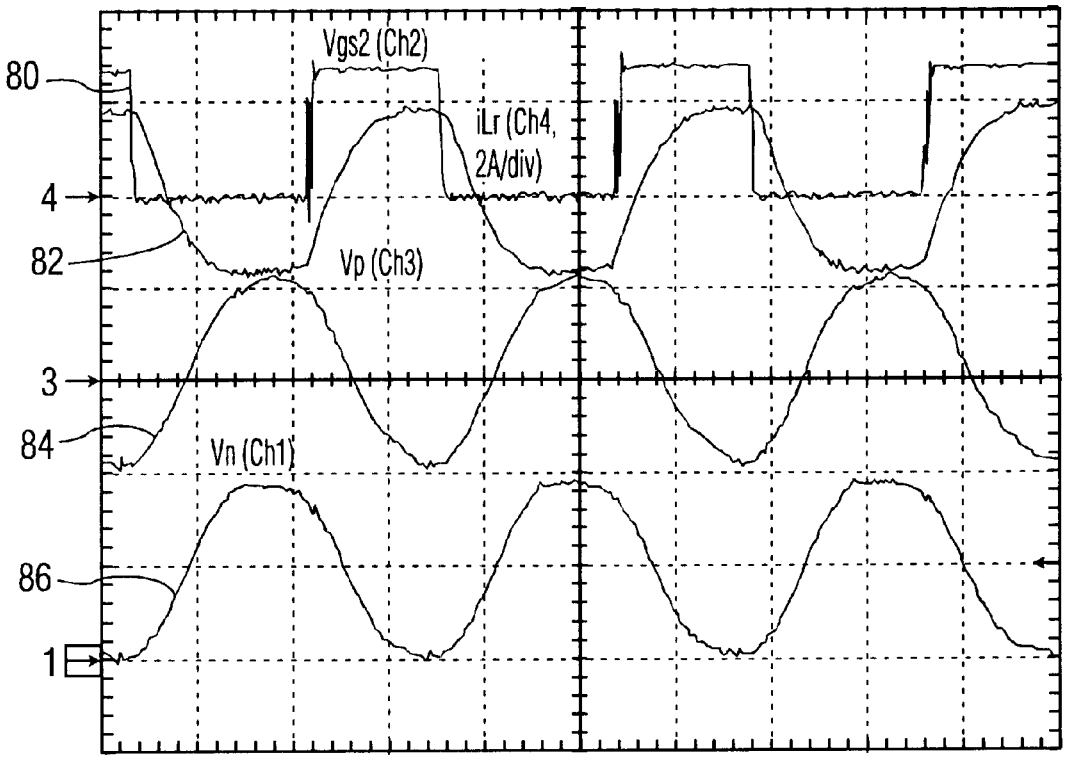
Figure 9B:
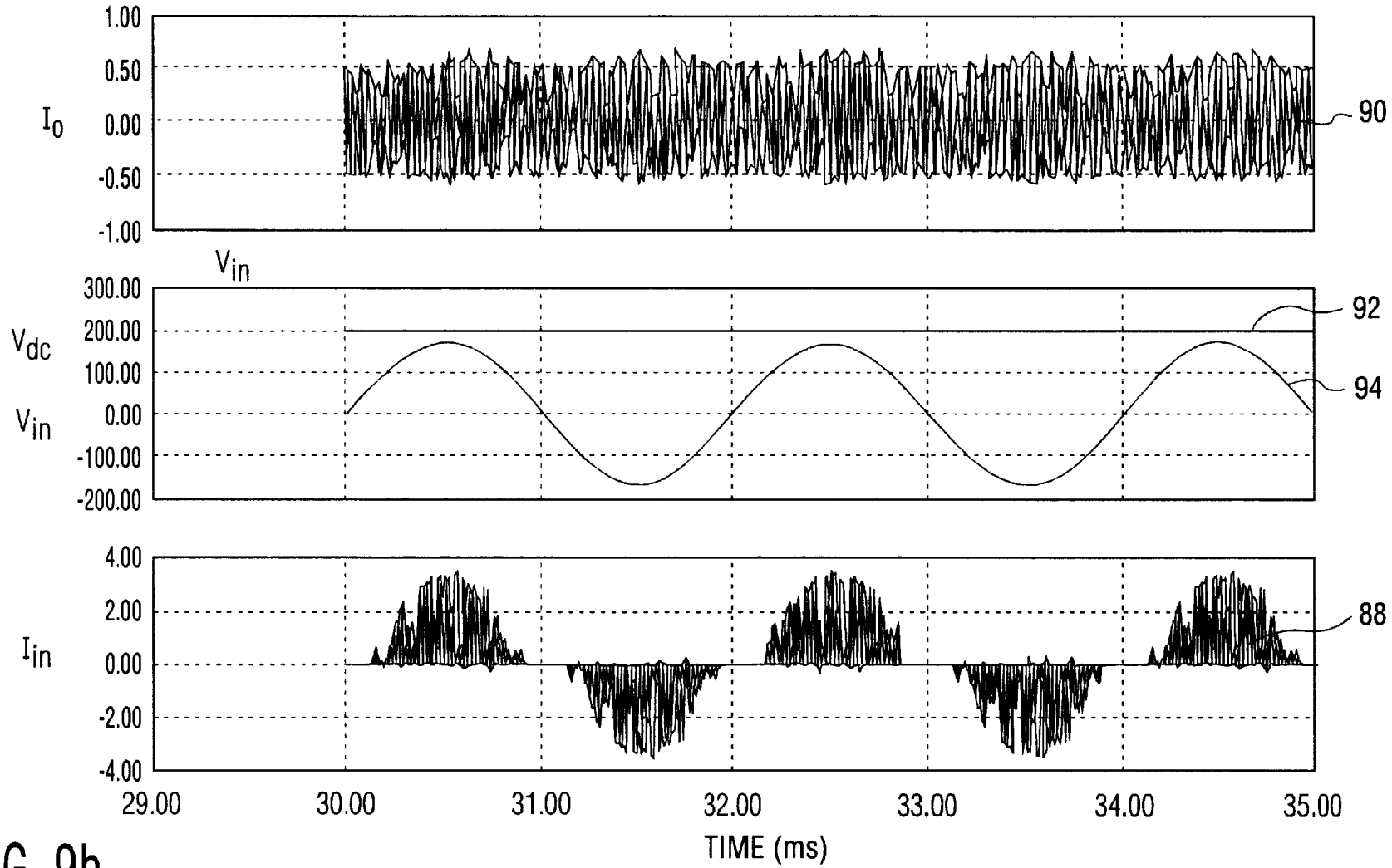
Figure 10A:
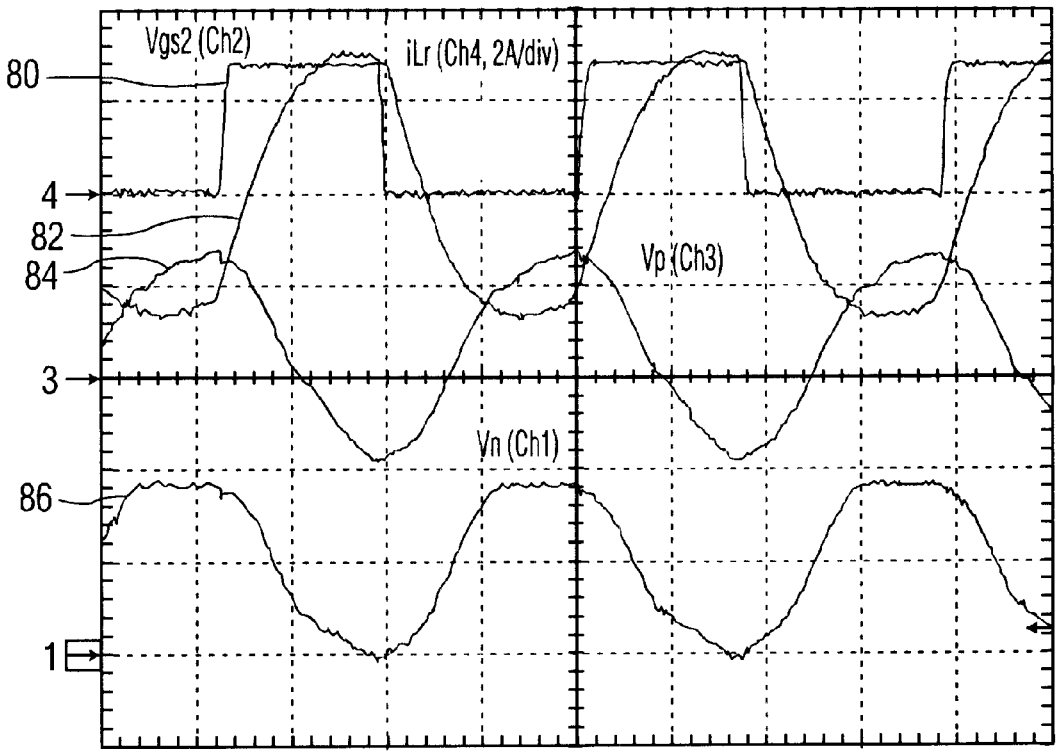
Figure 10B:
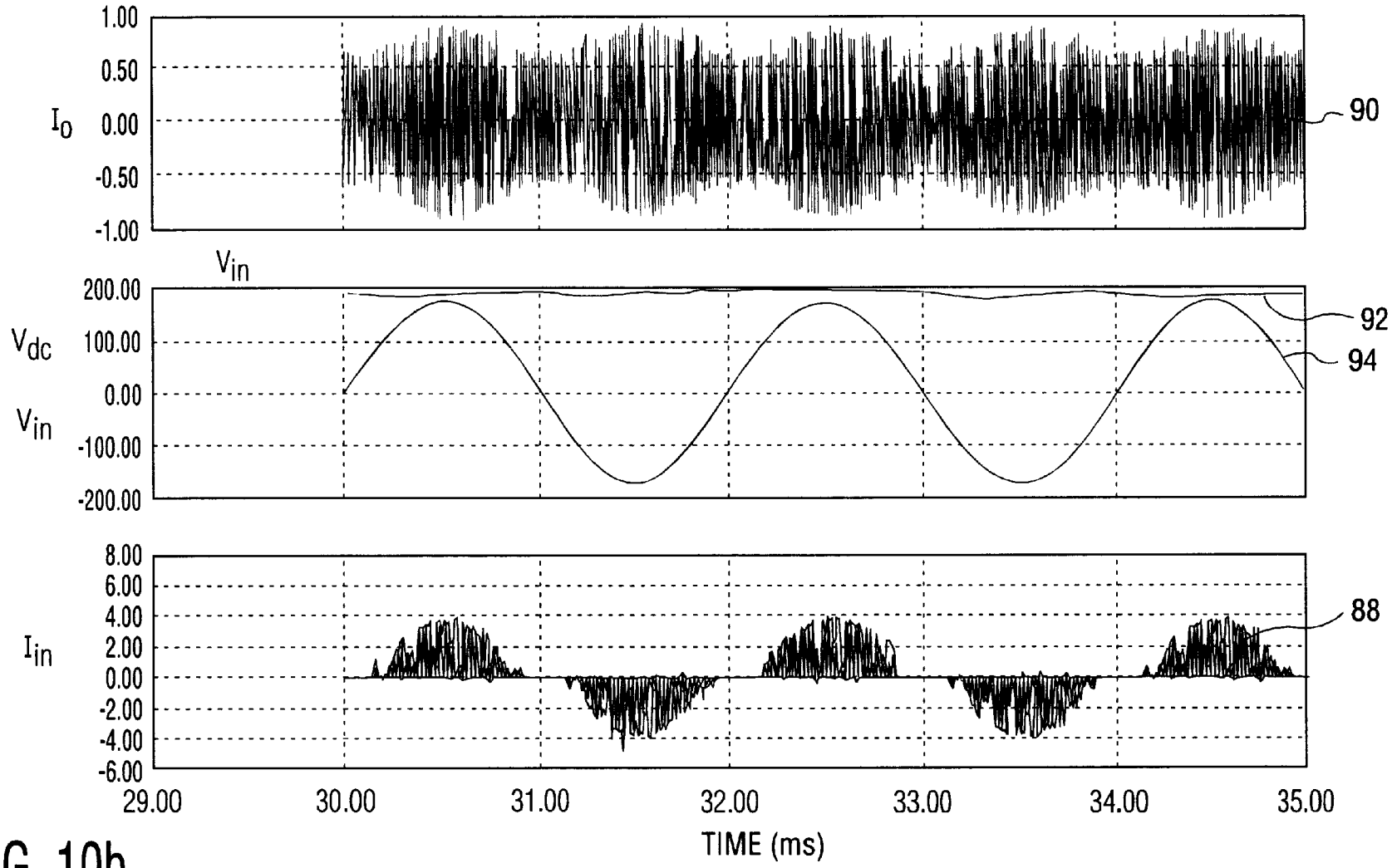
Figure 11A:
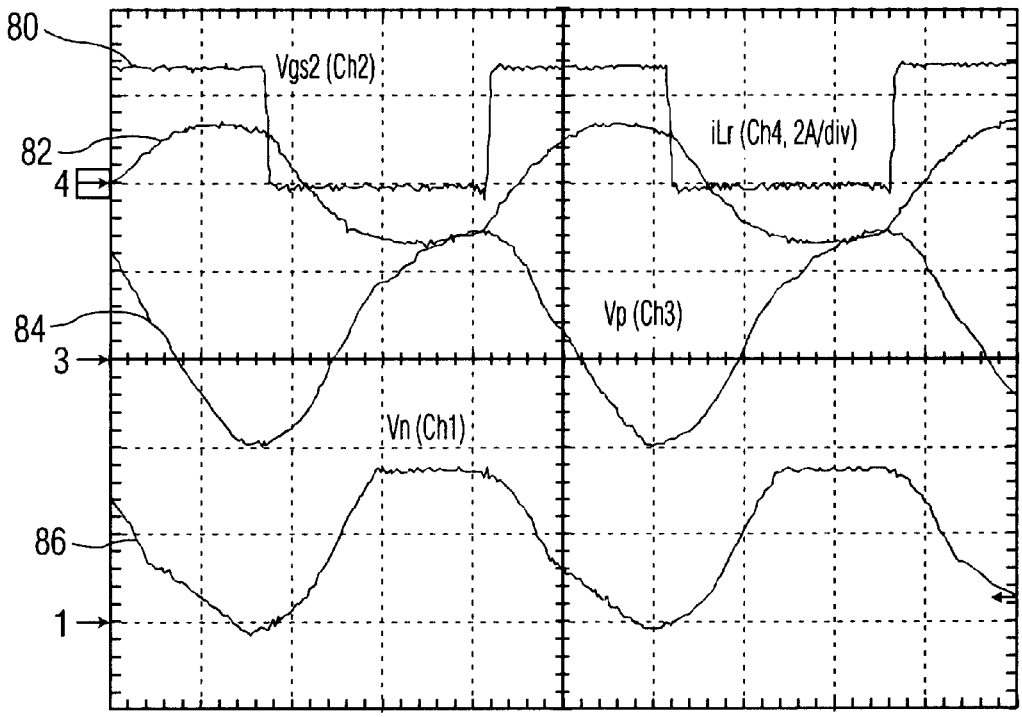
Figure 11B:
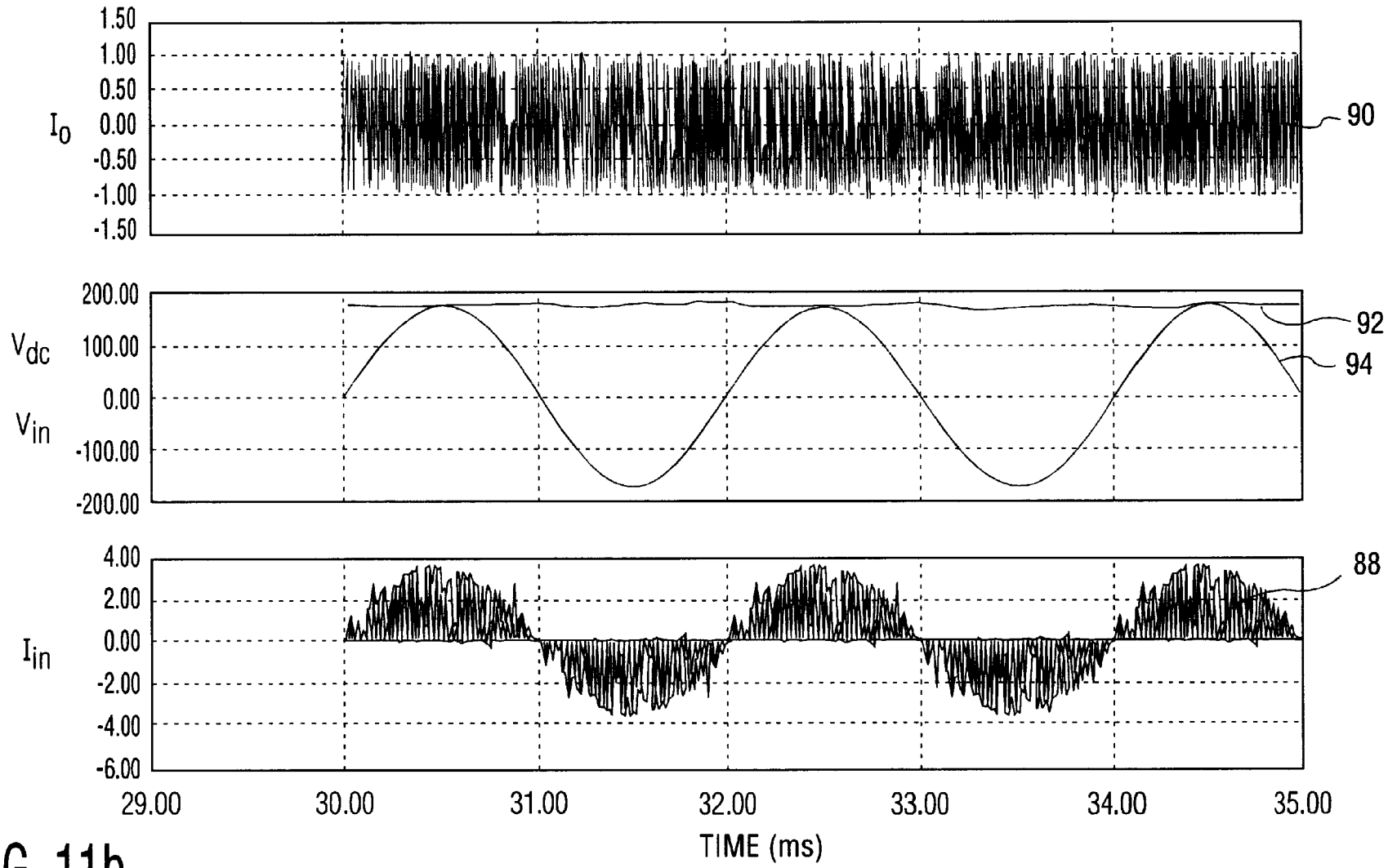

With this condition, the high frequency operation of the inventive circuit may be described by components of an equivalent circuit as shown in FIGS. 7*a*. In that circuit the resonant inductor current is modeled as an ideal current source $I_{Lr}$ and the output voltage is reflected to the primary side and modeled as an ideal voltage source $V_{pn}$ Further, the power feedback circuit 70 can be decomposed into two simpler power feedback circuits 72 and 74 (FIGS. 7*b, c*). In the first, high frequency circuit 72 (FIG. 7*b*), as compared to the input line frequency, the voltage source $V_{pn}$ modulates the voltage at point m via the charging capacitor $C_2$. This modulation causes the input current $i_{in}(t)$ (FIG. 7*b*) to be sinusoidaly shaped as represented by the curve 88 (FIG. 8*b*).

In the second circuit 74 (FIG. 6*c*), the current source $I_{lr}$ charges/discharges the capacitor $C_8$ and shares the input current accordingly. It is important to note that there is a phase difference between the signals $V_{pn}(t)$ and $I_{Lr}(t)$. It is this phase difference that allows the rectifier circuit $D_1$–$D_4$ to conduct current twice, makes the circuit 70 the double path type power feedback circuit. In each high frequency cycle, the double path type power feedback circuit 70 generates two small current pulses in the input line. The envelope of these small pulses follows a pseudo-sinusoidal shape. By using proper input line filter, for example the inductor $L_1$ and the capacitor $C_1$, the input current will become close to the sinusoidal waveform with a low THD, as represented by the curve 88 (FIG. 8*b*).

FIGS. 8–11 show the high frequency oscilloscope waveform curves representing voltages at different points in the circuit 40 (FIG. 3). Specifically, FIGS. 8*a,* 9*a,* 10*a,* and 11*a* show the following waveform curves for the one, two, three, and four lamp configurations respectively:

1. The gate drive waveform curve 80 showing $V_{gs2}(t)$ for the switch $Q_2$ (FIG. 3);
2. The resonant inductor current curve 82 for the current $i_{Lr}(t)$ (FIG. 3);
3. The voltage waveform curve 84 for voltage $V_p(t)$ at point p (FIG. 3), and
4. The voltage waveform curve 86 for voltage $V_n(t)$ at point n (FIG. 3)

Similarly, FIGS. 8*b,* 9*b*, 10*b*, and 11*b* show the waveform curves 88 for the input line current $I_{in}$ (FIG. 3); 90 for the output lamp current $I_{lamp}$ (FIG. 3); 94 for the input voltage $V_{in}$ (FIG. 3); and 92 for the voltage $V_{dc}$ (FIG. 3), in a low frequency scale for the one, two, three, and four lamp configurations respectively.

As a further explanation, with reference to FIG. 4, please consider the following functional description of a specific simplified embodiment circuit 50 of the present invention. By varying values of $R_l$ and $C_l$, all four lamp load states may be accounted for. For example, if $R_l$ and $C_l$ denote the equivalent impedance of one lamp and its associated ballast capacitance, then for n-number of lamps the equivalent impedance becomes $R_l/n$ and the equivalent series ballasting capacitance becomes $nC_l$.

The input line voltage $V_{in}$ is a rectified sinusoidal waveform. Because the line frequency, e.g., 60 Hz, is much lower than the circuit switching frequency, e.g., 43 kHz, the input line voltage $V_{in}$ is assumed to be constant in high frequency cycles. Furthermore, a DC bus voltage ripple may be ignored due to the large capacitance of $C_{10}$. In the case of a 60 Hz, 120 V, AC input voltage, the DC bus voltage, $V_{dc}$, is kept under 220 volts. With the above assumptions, eight equivalent topological stages in each high frequency switching cycle may now be identified.

Figure 12A:
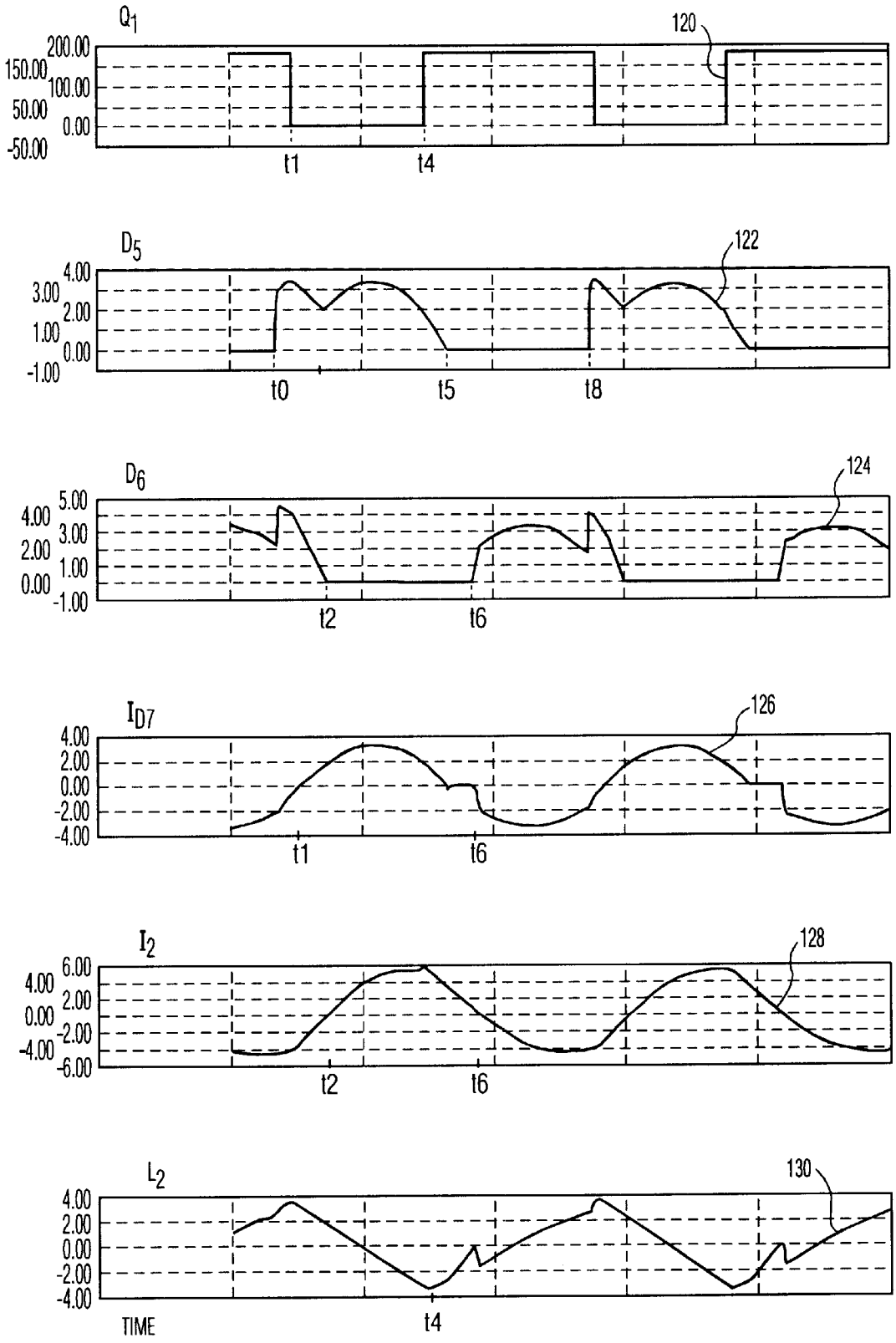
FIGS. 12(*a, b*) are voltage, current/time oscilloscope waveform charts showing a set of switching waveforms of the inventive circuit shown in FIG. 4 with respect to eight intervals depicted in FIGS. 13*a–h*.

Switching waveforms of the circuit 50 having eight equivalent topological stages corresponding to time intervals $[t_j, t_{(j+1)}]$, where j=0, . . . , 7, are presented in FIG. 12. These equivalent topological stages are discussed below with the aid of FIGS. 13*a–h*. FIG. 13*a* shows the equivalent circuit during the first interval $[t_0, t_1]$. Starting from $t_0$, both diodes $D_5$ and $D_6$ conduct current $I_{d5}$ and $I_{d6}$, as shown by graphs 122 and 124 (FIG. 12) respectively, however no charging current reaches the capacitor $C_{10}$ (FIG. 4) because diode $D_7$ (FIG. 4) is off. Moreover, the capacitor $C_8$ (FIG. 4) is prevented from being further charged. During that interval, the line voltage source $V_{in}$ delivers power directly to the load via loop II 100, while the resonant tank circuit 42 operates in a free wheeling mode in loop I 102. The current in the capacitor $C_2$ is the difference between the resonant tank 42 current $i_L$ in loop I 102 shown as a graph 128 (FIG. 12) and the input line current $i_{D5}$ in loop II 100 shown as a grapl 122 (FIG. 12).

Figure 12B:
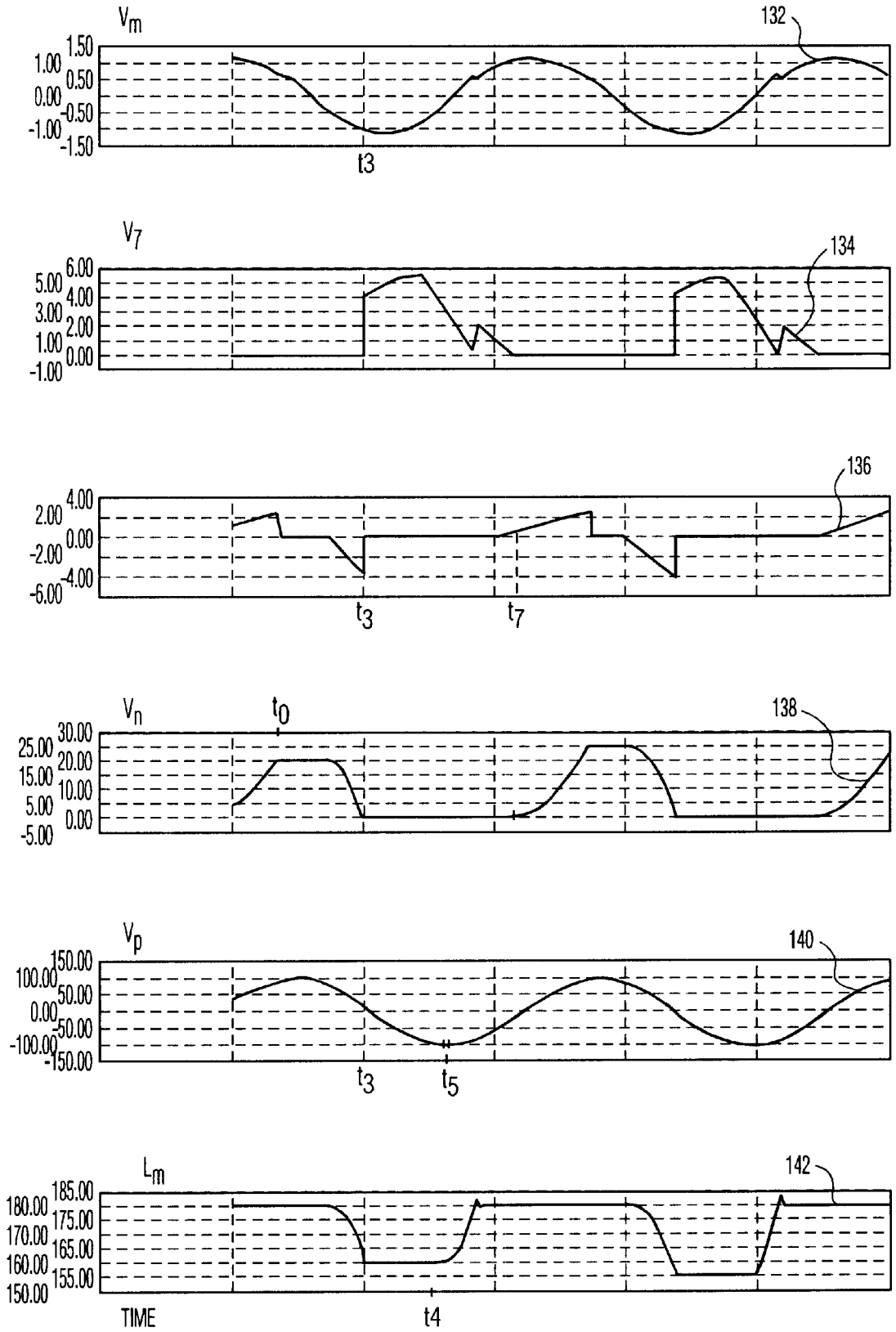
Figure 13A:
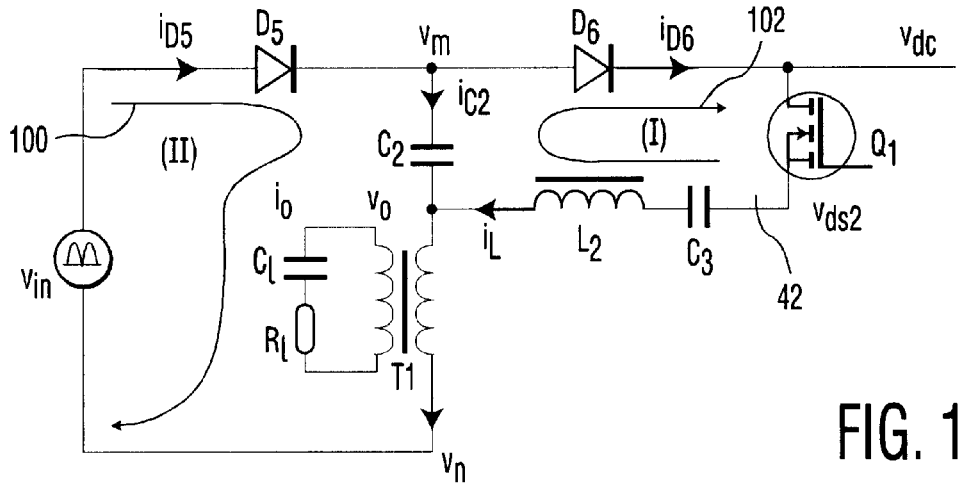
FIGS. 13*a–h* are each a schematic representation of an equivalent inventive circuit where the amplitude of the resonant inductor current and the output voltage vary in accordance with time intervals.
Figure 13B:
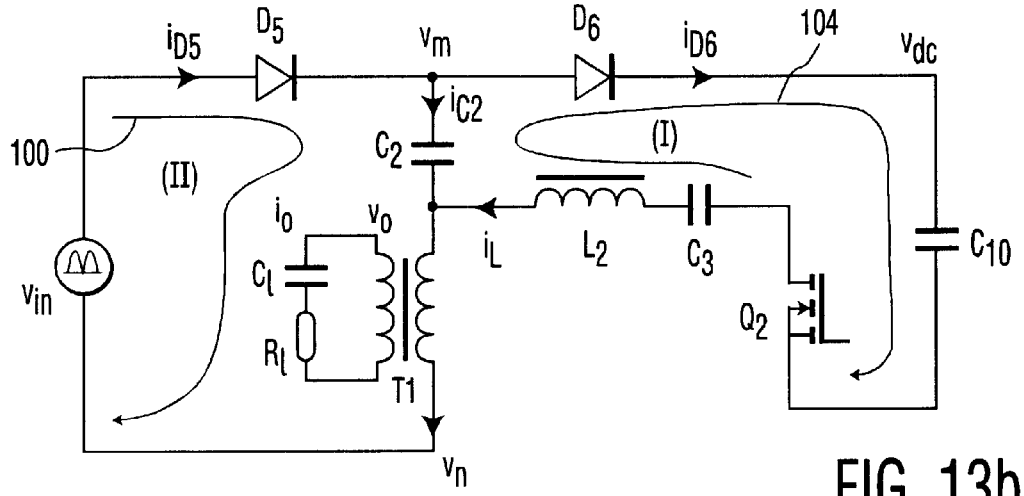

While the current $i_L$ is still in free wheeling state with the current direction indicated by loop I 102, the MOSFET $Q_1$ is turned off 120 (FIG. 12*a*), as shown in FIG. 13*b,* during the interval $[t_1, t_2]$, and the current is diverted to the MOSFET $Q_2$. Please note that the MOSFET $Q_2$ may be turned on with zero voltage switching. With the charging of the DC bulk capacitor $C_{10}$ via loop I 104, the current $i_L$ in the resonant inductor $L_2$, shown as the graph 128 (FIG. 12), gradually diminishes to zero. When the zero point is reached, diode $D_6$ is naturally turned off 124 (FIG. 12) and the second interval $[t_1, t_2]$ terminates.

Figure 13C:
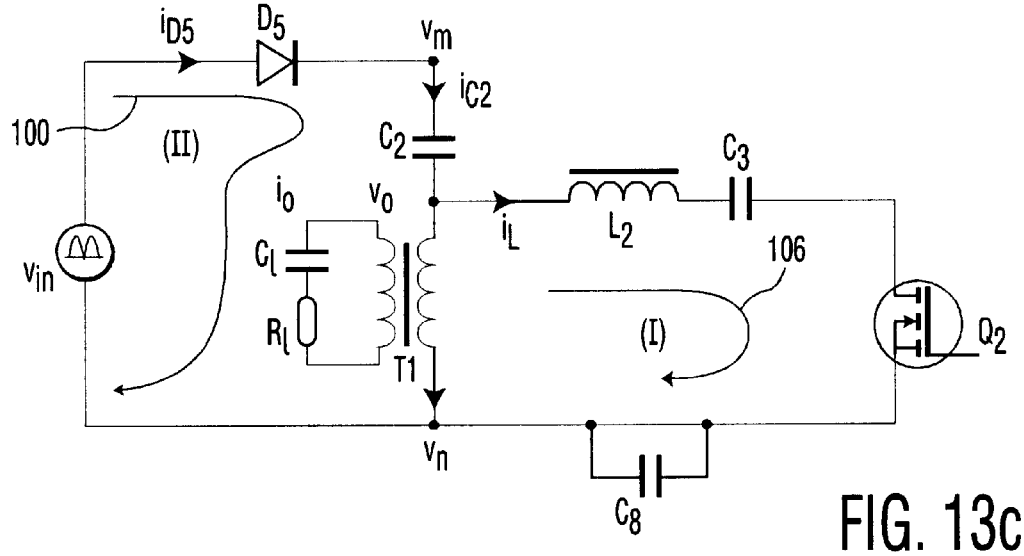

Following the switch off 124 (FIG. 12) of the diode $D_6$ during the third interval $[t_2, t_3]$ shown in FIG. 13*c,* the resonant inductor current $i_L$, shown as the graph 128 (FIG. 12), indicated by loop I 106, reverses direction and increases with the discharging of the capacitor $C_8$. During this interval, along with further discharging of the capacitor $C_8$, the voltage $V_p$ continuously drops, as shown by a graph 140 (FIG. 12). This drop is followed by continuous charging of the capacitor $C_2$ while the line voltage source $V_{in}$ delivers power directly to the load.

Figure 13D:
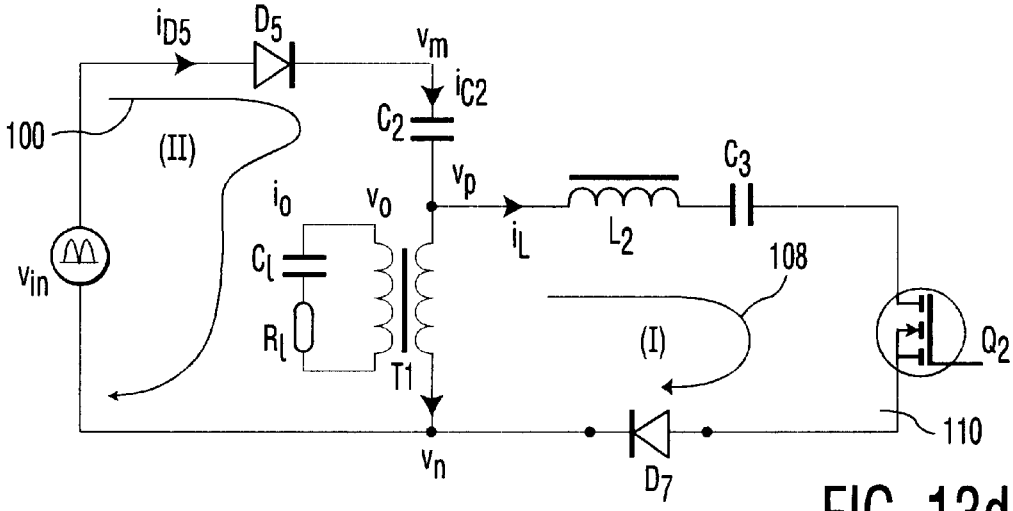

After the voltage $V_{in}$ across the capacitor $C_8$ drops to zero 128 (FIG. 12), as is shown in FIG. 13*d,* the diode $D_7$ begins conducting current. During this fourth interval $[t_3, t_4]$, the resonant tank 42 current $I_L$, shown as the graph 128 (FIG. 12), in loop I 108 is further increased with the resonant frequency being determined by the inductor $L_2$, the capacitor $C_8$ (FIG. 4), the capacitor $C_l$, and the resistor $R_l$, turns ratio n and the magnetizing inductance $L_m$ of the output transformer. In the meantime, the current in the diode $D_5$ starts decreasing from its peak value, that is because voltage $V_p$ falls below zero, as shown in the graph 140 (FIG. 12) and goes in to a negative swing.

Figure 13E:
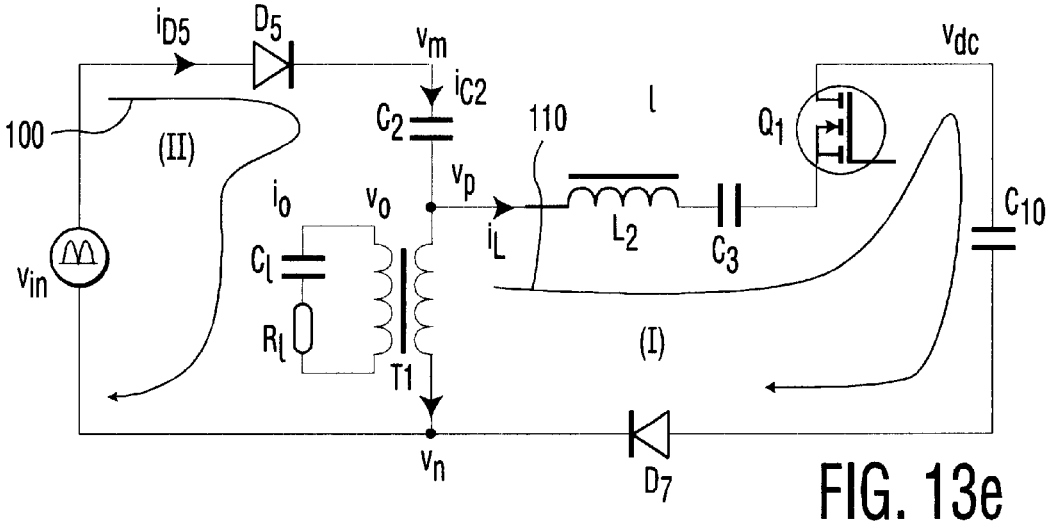
Figure 13F:
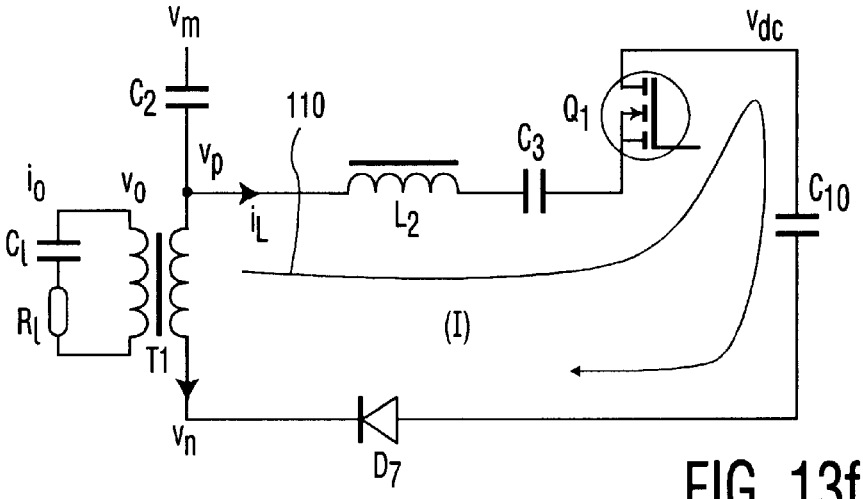

FIG. 13*e* shows the resonant tank current $I_L$ flowing in loop I 110 during the fifth interval $[t_4, t_5]$. At $t_4$, the MOSFET $Q_2$ is switched off. During this interval, the MOSFET $Q_1$ is turned on, as shown by graph 120 (FIG. 12*a*), which may be achieved with zero voltage switching (ZVS). As time reaches $t_5$, the voltage $V_p$ reaches its minimum value, as shown in the graph 140 (FIG. 12*b*) and the input current $I_{D5}$ approaches zero, as shown in a graph 122 (FIG. 12*a*). With the upswing of the voltage $V_p$, as shown in the graph 140 (FIG. 12*b*), the voltage $V_m$ increases correspondingly, as shown in the graph 132 (FIG. 12*b*), because $C_2$ is not being charged or discharged. At the same, as shown in FIG. 13*f,* during the sixth time interval $[t_5, t_6]$, the resonant inductor current $I_L$ is reduced to zero, as shown in the graph 128 (FIG. 12*a*),and the diode $D_7$ stops conducting.

Figure 13G:
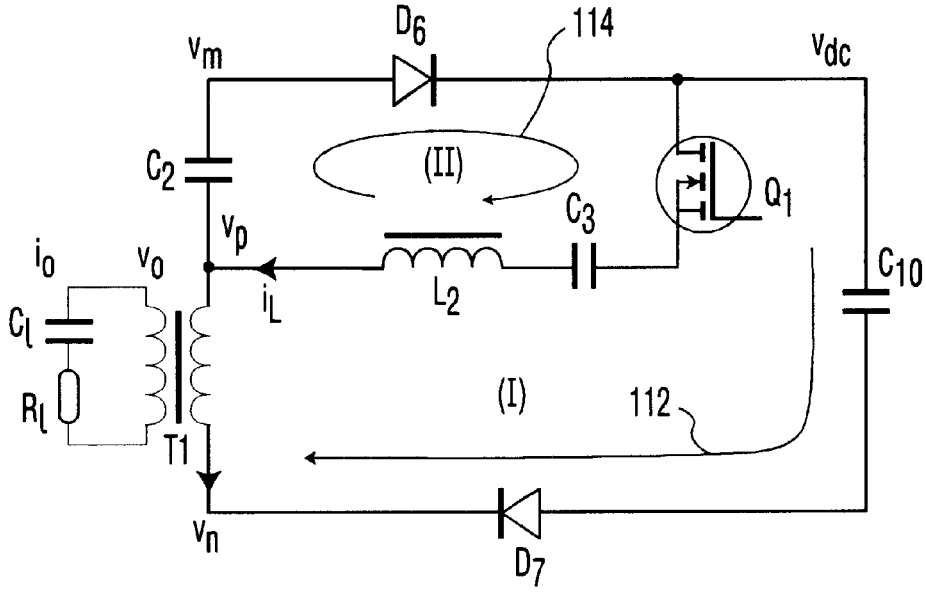

When the voltage $V_m$, as shown in the graph 132 (FIG. 12*b*), is greater than the voltage $V_{dc}$, during the seventh interval $[t_6, t_7]$ as shown in FIG. 13*g,* the diode $D_6$ begins conducting current, as shown in the graph 124 (FIG. 12*a*). Momentarily, the diode $D_7$ is switched on to help the voltage $V_m$ charge the capacitor $C_{10}$ via loop I 112. At the same time the capacitor $C_2$ begins discharging to transfer the energy stored in the capacitor $C_2$ into the resonant inductor current $i_L$, i.e., the electromagnetic energy. The current $i_L$ is then gradually built up from zero, as shown in the graph 128 (FIG. 12*a*).

Figure 13H:
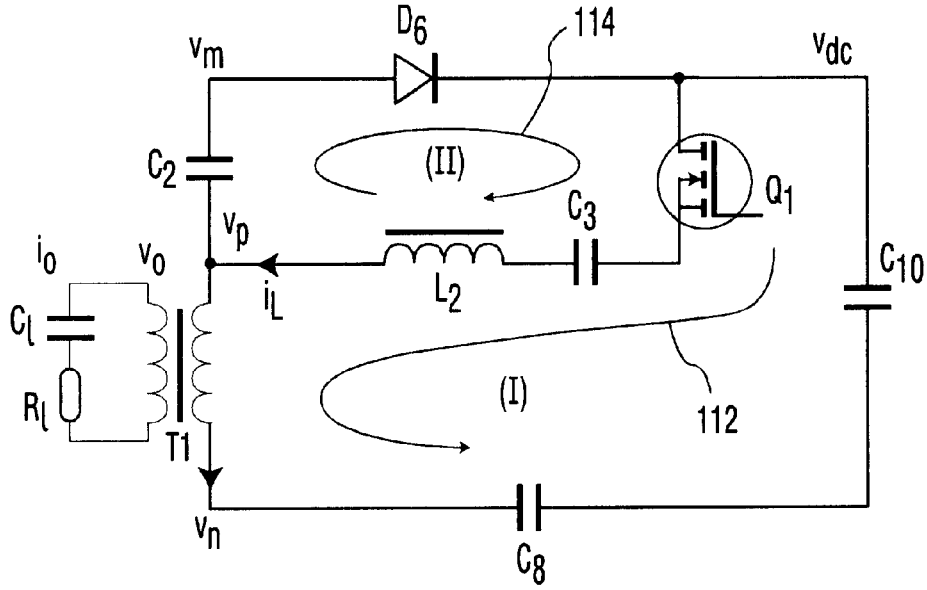

While the capacitor $C_2$ is continuously discharging via loop II 114, during eighth interval $[t_7, t_8]$, shown in FIG. 13*h*, the capacitor $C_8$ begins to charge via the loop I 112 with the DC bus capacitor $C_{10}$ providing the charging current through a load branch. As a result, the voltage $V_p$ increases, as shown in the graph 140 (FIG. 12*b*), and the voltage $V_m$ is kept greater than $V_{dc}$, as shown in the graph 132 (FIG. 12*b*).

While the equivalent circuit 50 (FIG. 4) holds true for each operating point of the sinusoidal input line voltage, the waveforms in FIGS. 12*a*, 12*b* and operating intervals in FIGS. 13*a–h* are shown for one typical operating point which may be around 80% of the input line peak voltage. At other operating points, the duration of each interval and even the number of intervals may vary; however, the circuit operating principles will remain the same. In each high frequency switching cycle from $t_0$ to $t_8$, there are two sections $[t_0, t_2]$ and $[t_2, t_5]$, where the circuit draws two current pulses from the line. The peak value of the pulses is low compared with a single pulse case of single path power feedback schemes. As a result, the resonant tank current is smaller and the associated losses are also smaller.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims.

Having thus described our invention, what we claim as new, and desire to secure by Letters Patent is:

1. A circuit for operating multiple discharge lamps in parallel in high frequency cycles comprising:

first and second input terminals for connection to a source of supply voltage for the circuit, a load circuit for connection to the multiple discharge lamps and including respective ballast capacitors for connection in series with respective discharge lamps when the lamps are connected to the load circuit, an output transformer having a primary winding and having a secondary winding coupled to the load circuit to supply thereto an output voltage, an LLC resonant converter comprising at least one power transistor operated at a high frequency and coupled to the input terminals and to the output transformer primary winding, and a resonant circuit including first and second resonant inductor means and at least one resonant capacitor coupled to said first and second resonant inductor means, wherein the at least one power transistor generates a resonant inductor current in the first resonant inductor means and the resonant frequency of the resonant circuit is below the operating frequency of said at least one power transistor, means coupling the first resonant inductor means to the primary winding of the output transformer, and power feedback means coupling at least the first input terminal to an input terminal of the resonant converter.

2. The discharge lamp operating circuit as claimed in the claim 1 further comprising;

means for controlling a condition of the operating circuit such that said resonant inductor current and the output voltage each have an almost constant amplitude during steady state operation of one or more connected discharge lamps.

3. The discharge lamp operating circuit as claimed in claim 2 wherein said power feedback means comprises a first capacitor coupled to the resonant circuit so that said resonant inductor current charges and discharges said first capacitor.

4. The discharge lamp operating circuit of claim 2, wherein a phase difference exists between primary winding voltage and said resonant inductor current.

5. The discharge lamp operating circuit as claimed in claim 2 wherein the condition controlled is the operating frequency of said at least one power transistor.

6. The discharge lamp operating circuit of claim 1, wherein the power feedback means is arranged so that in each of said high frequency cycles, said operating circuit conducts input current twice.

7. The discharge lamp operating circuit of claim 6, which comprises first and second power transistors and said power transistors generate said resonant inductor current by alternately switching on and off, said power transistors having a 50% duty ratio.

8. The discharge lamp operating circuit as claimed in claim 1 wherein the power feedback means comprises first and second power feedback circuits, the first power feedback circuit including first and second series connected diodes coupled between the first input terminal and a first input terminal of the resonant converter, and the second power feedback circuit includes a third diode coupled between the second input terminal and a second input terminal of the resonant converter.

9. The discharge lamp operating circuit of claim 1, wherein the output transformer has a magnetizing inductance adapted to optimize said power feedback means.

10. The discharge lamp operating circuit of claim 1, further comprising:

an input line filter having an inductor and a capacitor, wherein said input line filter filters an input current to approach a sinusoidal waveform with a low THD;

a current rectifying circuit comprising a plurality of diodes coupled to the input line filter;

first and second fast reverse recovery diodes coupled between a first output of the current rectifying circuit and a first input of the resonant converter, and a third fast reverse recovery diode coupled between a second output of the current rectifying circuit and a second input of the resonant converter; and a DC storage capacitor coupled to said at least one power transistor and a DC blocking capacitor coupled to the first resonant inductor means.

11. The discharge lamp operating circuit of claim 1, wherein said power feedback means is a part of said resonant circuit and produces in an input current of the operating circuit a close to unity power factor for different numbers of said multiple discharge lamps.

12. The discharge lamp operating circuit of claim 11, wherein for an input voltage of 120 volts a DC bus voltage of said operating circuit is under 220 volts.

13. The discharge lamp operating circuit of claim 12, wherein said circuit is operated at a first frequency where for each of said different number of lamps the DC bus voltage is kept under 220 Volts.

14. The discharge lamp operating circuit of claim 11, wherein for each of said different number of lamps, an operating frequency of the at least one power transistor is kept constant without line frequency modulation.

15. The discharge lamp operating circuit as claimed in claim 8 wherein the second power feedback circuit includes a first capacitor coupled in parallel with said third diode.

16. The discharge lamp operating circuit as claimed in claim 15 wherein the first resonant inductor and the one resonant capacitor are connected in a series circuit between one main electrode of the one power transistor and a circuit point between the first and second series connected diodes of the first power feedback circuit.

17. A circuit for operating multiple discharge lamps in parallel, comprising:

first and second input terminals for connection to a source of supply voltage for the circuit, a load circuit for connection to the multiple discharge lamps and including respective ballast capacitors for connection in series with respective discharge lamps when the lamps are connected to the load circuit, an output transformer having a primary winding and having a secondary winding coupled to the load circuit to supply thereto an output voltage, an LLC resonant converter comprising first and second resonant inductor means, at least one power transistor operated at a high frequency and coupled to the input terminals and to the output transformer primary winding, and at least one resonant capacitor coupled to said first and second resonant inductor means to form a resonant circuit for deriving a first voltage, and means coupling at least the first resonant inductor means to the primary winding of the output transformer and to the at least one power transistor so as to derive a second voltage at the primary winding.

18. The discharge lamp operating circuit as claimed in claim 17 wherein the output transformer has a magnetizing inductance which forms said second resonant inductor means.

19. The discharge lamp operating circuit as claimed in claim 18 further comprising a double path type power feedback circuit coupled to the first and second input terminals and to the LLC resonant converter such that in each cycle of said high frequency the circuit receives two input current pulses.

20. The discharge lamp operating circuit as claimed in claim 17 wherein the LLC resonant converter comprises first and second power transistors coupled to the input terminals and to the resonant circuit, and further comprising means for controlling the switching of said first and second power transistors so that in steady state operation an almost constant current flows through the first resonant inductor means and the output voltage is almost constant.

21. The discharge lamp operating circuit as claimed in claim 18 further comprising a double path type power feedback circuit coupled to the first and second input terminals and to the LLC resonant converter, and said magnetizing inductance of the output transformer is adapted to optimize said power feedback circuit.

22. The discharge lamp operating circuit as claimed in claim 17 wherein said input terminals are connected to output terminals of a bridge rectifier having input terminals for connection to a source of low frequency AC voltage, and in steady state operation of the circuit a phase difference is present between said second voltage and a resonant inductor current flowing in the first resonant inductor means, whereby, in each high frequency cycle the bridge rectifier conducts current twice.

23. The discharge lamp operating circuit as claimed in claim 17 wherein the LLC resonant converter comprises;

first and second power transistors connected in series circuit to the input terminals via diode means, means coupling the at least one resonant capacitor in series with the output transformer primary winding to the input terminals and to the first and second power transistors, means coupling the first resonant inductor means to a first circuit point between the one resonant capacitor and the primary winding and to a second circuit point between the first and second power transistors, and the circuit further comprises;

a storage capacitor coupled to the first and second power transistors.

24. The discharge lamp operating circuit as claimed in claim 23 wherein said input terminals are connected to output terminals of a bridge rectifier having input terminals for connection to a source of low frequency AC voltage via an input line filter including an inductor and a capacitor, and a fast recovery diode in parallel circuit with a further capacitor, said parallel circuit being coupled to one side of the output transformer primary winding and to one main electrode of the second power transistor.

25. A ballast circuit for a parallel operation of multiple lamps, each of the lamps having a ballasting capacitor, said circuit comprising:

a power feedback circuit; and a LLC resonant converter operating at a high frequency and comprising a resonant inductor connected on one side to an output transformer having magnetizing inductance, and connected on the other side to at least one capacitor, a part of said LLC resonant converter forming a resonant circuit for generating a first voltage, said resonant circuit having a resonant frequency below the converter operating frequency and allowing said power feedback circuit to produce an acceptable power factor in said input current of the ballast circuit for different numbers of said multiple lamps.

* * * * *